US005829274A

United States Patent [19]

Fleissner

[11] Patent Number: 5,829,274

[45] Date of Patent: Nov. 3, 1998

[54] DEVICE FOR CLEANING WEBS

[75] Inventor: Gerold Fleissner, Zug, Switzerland

[73] Assignee: Fleissner GmbH & Co., Maschinenfabrik, Egelsbach, Germany

[21] Appl. No.: 823,485

[22] Filed: Mar. 25, 1997

Related U.S. Application Data

[62] Division of Ser. No. 612,336, Mar. 7, 1996, Pat. No. 5,653,771.

[30] Foreign Application Priority Data

Mar. 9, 1995 [DE] Germany ..... 195 08 176.5

[51] Int. Cl.[6] ..... D06B 5/08

[52] U.S. Cl. ..... 68/5 D

[58] Field of Search ..... 8/137, 149.1, 149.3, 8/151; 68/5 D, 6

[56] References Cited

U.S. PATENT DOCUMENTS 3,925,905 12/1975 Zeiffer ..... 34/115 X 3,986,274 10/1976 Holm ..... 68/5 D X 4,137,045 1/1979 Brugman ..... 68/5 D X

FOREIGN PATENT DOCUMENTS 1234785 6/1971 United Kingdom ..... 68/5 D

*Primary Examiner*—Philip R. Coe

*Attorney, Agent, or Firm*—Antonelli, Terry, Stout & Kraus, LLP

[57] ABSTRACT

In a washing method, a web of textile goods is wetted with a washing-active liquid and the liquid is caused to foam by steam which is blown at high pressure into a back side of the web of goods with a pile on the front side. The steam is discharged from a nozzle slot that extends transversely across the web of goods. The nozzle directs the steam against the web and through it. The foam which then suddenly forms is then drawn off by a vacuum or suction together with the liquid still in the pile from the pile side of the web.

4 Claims, 1 Drawing Sheet

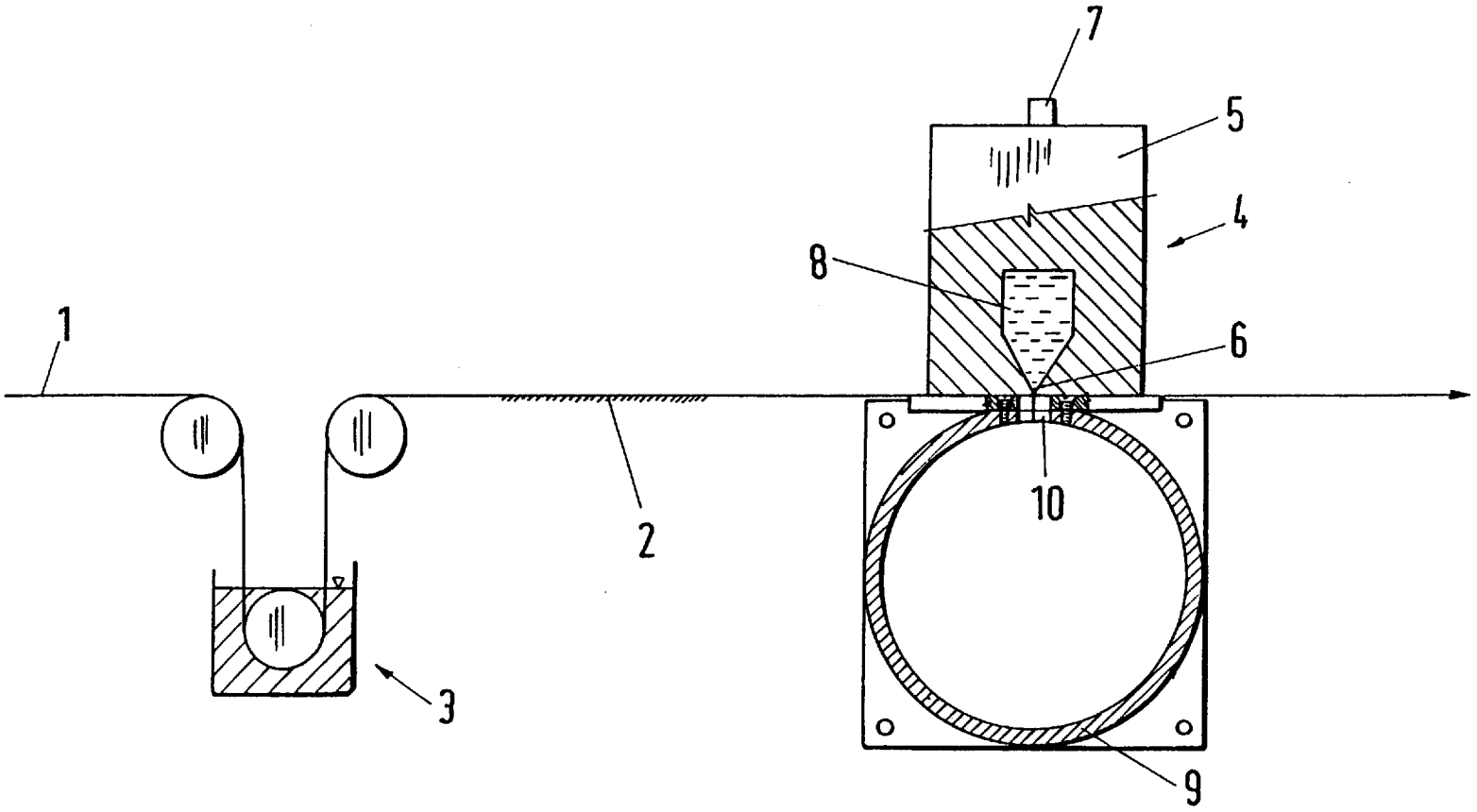
1
2
3
4
5
6
7
8
9
10

DEVICE FOR CLEANING WEBS

This application is a Divisional application of application Ser. No. 08/612,336, filed Mar. 7, 1996, and now U.S. Pat. No. 5,653,771.

FIELD OF THE INVENTION

This invention relates to a method for cleaning continuously moving textile material in web form with a washing-active liquid having an adsorptivity for the contaminants to be washed out of the textile material and no affinity for the fibers of the textile material. The liquid also contains chemicals to form foam in the presence of steam. After being applied to the textile material, the liquid is subjected immediately thereafter to steam to generate a foam that is active in washing.

A similar method is known from DE 43 16 061 A1. This known method is very advantageous, basically because sufficient cleaning of the substances to be washed out of the textile material with few measures is possible. Only the cost of the equipment if high, due solely to the saturated steam evaporator required for generating a steam atmosphere.

SUMMARY OF THE INVENTION

The goal of the invention is to develop a method and a device required therefor in which the idea of washing with steam is retained, but the treating process can proceed more rapidly and the required device can therefore also remain smaller.

Taking its departure from the method described in DE 43 16 061 A1, the invention proposes to achieve the stated goal by blowing the steam directly into the textile material at high pressure to generate the foam. Saturated steam is therefore no longer required to act for a certain length of time on the textile material wetted by the treatment liquid, generating the foam thereby, said foam then being drawn off to remove the dirt. Rather, it is merely necessary to blow steam supplied at high pressure into, or better still through, the textile material. The reaction with the previously added liquid that is active during washing then takes place abruptly. The steam blown into one side of or through the textile material creates the foam and then removes the foam laden with dirt from the textile material as soon as it has passed through the textile material. It is advantageous in this regard to apply suction to the other side of the textile material (advantageously the front of a web of goods with a pile). Dewatering of the web is thus performed simultaneously.

The device for working the method is especially simple in design and therefore economical. The entire washing device then consists of a liquid applicator for the washing-active liquid and a nozzle beam arranged crosswise with respect to the web of textile material or goods, from which beam compressed steam emerges with high dynamic energy, against and through the web of goods. A suction device for the steam or for the dirt to be removed should be included and it can also be part of the nozzle-steam device.

BRIEF DESCRIPTION OF THE DRAWING

The sole figure of the accompanying drawings show a chematic cross sectional view crosswise through a washing device for conducting the method of the invention.

DETAILED DESCRIPTION OF DRAWING

The sole figure shows the moving web of goods 1, whose pile 2 is directed downward between liquid applicator 3 and the steaming device 4. Liquid applicator 3 can consist of the dipping bath device shown or another known type of applicator. The steaming device in this case comprises a simple nozzle beam 5 arranged crosswise above the web 1 of the textile material and having an nozzle slot 6 on its underside facing web 1. Slot 6 has an extremely fine cross section through which the steam escapes uniformly under pressure over its length, which corresponds to the width of the web. For this purpose nozzle beam 5 has a steam supply connection 7 and a steam distributing chamber 8. The size of the cross section of the slot depends on the amount of steam required for washing. The steam pressure should be high enough to generate the foam by means of the steam and then to blow out, at least partially, along with the steam, the foam as well as any liquid contained in the textile material.

To reinforce this cleaning process and also to support the removal of the foam, at the level of and parallel to nozzle slot 6, a suction device 9, e.g., an elongated beam or pipe, with an upwardly directed suction slot 10 is provided on the other side of web 1. In this way, the steam that emerges on pile side 2 of web 1 can be removed immediately while simultaneously collecting the foam laden with dirt and possibly the liquid contained in pile 2. Instead of suction device 9, a steam table can also be provided on the other side of web 1. This causes the steam to penetrate the pile more intensively. The table, however, has the disadvantage that the steam flowing into it is not drawn off uniformly, which can make operation difficult. Of course, a steam suction hood can also be provided above the suction device.

The suction applied on the front side of the textile material creates a suction stream of air and vapor, which is reinforced by the steam supplied to the back side of the textile material. It will be appreciated that the steam supplied during suction is forced through the textile material from the back side in a direction toward the suction stream created by the suction. In order to effect complete removal of the steam, it is advantageous that the suction stream is made proportional to the steam flow directed onto the back side of the textile material.

The steam is blown onto the textile material at a pressure of 2 to 10 bars.

Tests have shown that excellent washing results can be obtained with a device with the above construction, which is much smaller than known washing devices.

The liquid for foaming under a steam atmosphere is sold for example by the Bayer company under the trademark "Levalin VKU-N". It consists basically of an alkylamide with an alkyl polyglycol sulfate. It is acid-resistant and is used essentially for polyamide tufting carpets. The same liquid is sold by the Ciba-Geigy company under the trade name "Irgapadol PN" and is prepared on the basis of a fatty acid amide and an alkyl polyglycol sulfate. The liquid is anionic and has a pH of 6.5–7.5.

What is claimed is:

1. A device for conducting a method for cleaning continuously moving textile material in web form by washing out contaminants contained in the textile material, which method comprises applying a washing-active liquid that contains a compound that exhibits adsorptivity for the contaminants to be washed out of the textile material and no affinity for fibers of the textile material, as well as at least one compound for forming foam in the presence of steam, and immediately thereafter blowing pressurized steam into the textile material to generate a washing-active foam, the device comprising a washing device which includes means for moving the web along a given path, a liquid applicator located on said path and associated with the web for applying to the web the washing-active liquid which contains chemicals to form foam in the presence of steam, and a nozzle beam extending lengthwise over an entire width of the web; said beam having a nozzle slot directed against one side of the web and completely open for all of its length for blowing steam into the web to activate said foam, and said slot having a connection for receiving steam supplied under pressure.

2. A device according to claim 1, wherein on the other side of the web, is a suction device associated with the nozzle beam which is provided parallel to the nozzle beam for applying suction to the steam discharged by the nozzle slot.

3. The device of claim 2, further comprising means for suctioning steam and foam during or after steam is blown at high pressure into said one side of the web.

4. The device of claim 3, wherein said means for suctioning steam is located on another side of the web, opposite said nozzle slot for blowing steam.

* * * * *